US006662962B2

(12) United States Patent
Neto

(10) Patent No.: US 6,662,962 B2
(45) Date of Patent: Dec. 16, 2003

(54) FLEXIBLE LINER FOR SHIPPING BULK LOAD INSIDE SHIPPING CONTAINERS AND METHOD FOR PLACING SAID FLEXIBLE LINER FOR SHIPPING BULK LOAD INTO A SHIPPING CONTAINER

(75) Inventor: Hercilio de Fontes Galvao Neto, Santos (BR)

(73) Assignee: Keyworld de Embalagens Ltda., Santos (BR)

( * ) Notice: Subject to any disclaimer, the term of this patent is extended or adjusted under 35 U.S.C. 154(b) by 0 days.

(21) Appl. No.: 10/189,783

(22) Filed: Jul. 8, 2002

(65) Prior Publication Data

US 2003/0047561 A1 Mar. 13, 2003

(30) Foreign Application Priority Data

Sep. 13, 2001 (BR) ..... 0106400

(51) Int. Cl.[7] ..... B65D 90/04

(52) U.S. Cl. ..... 220/1.6; 220/495.01

(58) Field of Search ..... 220/1.6, 495.01, 220/495.05, 495.06

(56) References Cited

U.S. PATENT DOCUMENTS

| | | | | | |
|---|---|---|---|---|---|
| 4,875,596 | A | * | 10/1989 | Lohse | 220/1.6 |
| 4,941,589 | A | * | 7/1990 | Chen | 220/1.6 |
| 5,193,710 | A | * | 3/1993 | Podd et al. | 220/1.6 |
| 5,542,563 | A | * | 8/1996 | Matias | 220/1.6 |
| 5,595,315 | A | * | 1/1997 | Podd et al. | 220/1.5 |
| 5,971,185 | A | * | 10/1999 | Schutz | 220/1.6 |

* cited by examiner

*Primary Examiner*—Joseph M. Moy
(74) *Attorney, Agent, or Firm*—Dennison, Schultz & Dougherty

(57) ABSTRACT

A flexible liner for shipping containers is provided and includes a flexible sack made of impermeable plastic material configured and dimensioned to be places in standard containers, and fastening means that will keep the flexible liner suspended from the superior part of the container.

8 Claims, 17 Drawing Sheets

Figure 1:
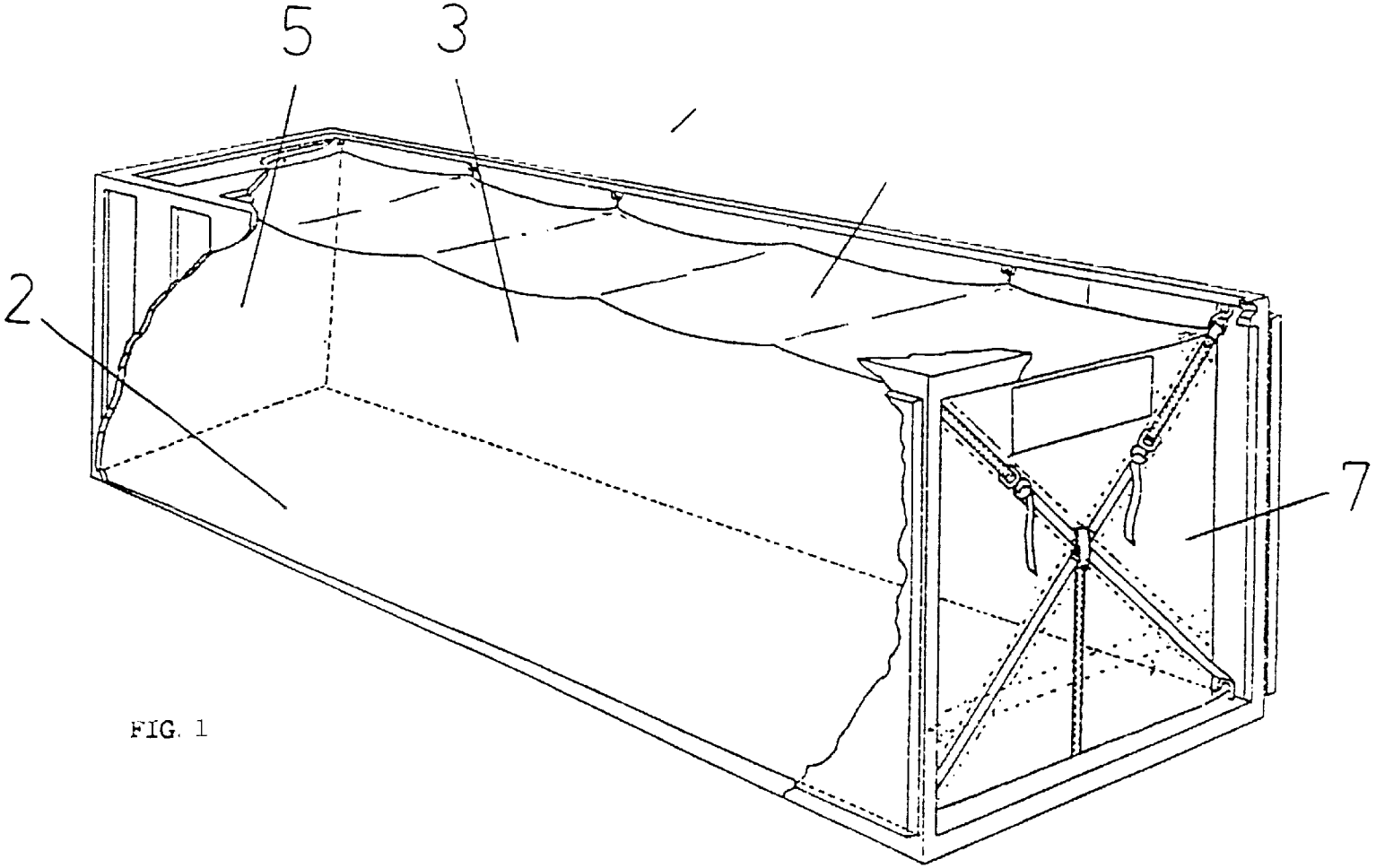

FLEXIBLE LINER FOR SHIPPING BULK LOAD INSIDE SHIPPING CONTAINERS AND METHOD FOR PLACING SAID FLEXIBLE LINER FOR SHIPPING BULK LOAD INTO A SHIPPING CONTAINER

The present invention refers to a flexible liner for shipping bulk load inside shipping containers which is basically constituted of a flexible liner that is configured in the form of a sack or bag, and which is intended to be placed inside a plurality of means of transport for bulk load, such as towers, trucks, rail wagons or containers for load storage by air or sea, as well as a method for placing said flexible liner inside a space or container for bulk load storage.

As we know, presently, the transport of bulk load, whose materials may include substances in the form of powders, balls, flakes or granules, also including grains, liquids and others, is usually made in containers, whose dimensions meet the international specifications, and which may be transported fitted on land based vehicles, and these said containers will further be able to, for economic reasons, be stacked, one on another, to allow its transport on board of ship or aircraft.

Many types of flexible liners already known from the state of the art are placed inside containers, which usually present a rectangular configuration, and kept suspended inside the container through means of support that are attached into eyelets disposed in the superior part of the internal side walls of the container; however, it was found that most of these flexible liners presents the inconvenience of having their fastenings loosened from the eyelet, and even their tearing, in function of the conditions they are submitted during transport of the container, due to the movement of the load inside the flexible liner, it may allow the bulk load to spill from the liner into the container, causing therefore its loss and/or contamination of whole load, and, consequently, contaminating the container itself, and, in more extreme cases, besides it may cause serious accidents involving the personnel responsible for the discharge of the load; however, the most serious inconvenience observed on the usage of flexible liners known from the state of the art is the fact that, when the load is fed into the flexible liner for its shipment, or when the door of the container is opened for inspection of the load already loaded inside the flexible liner, part of the back wall of the flexible liner which becomes exposed suffers an arching outward, in function of the internal pressure that it is submitted by the load against the internal surface of said part of the back wall of the flexible liner, this fact may cause a great difficulty, or even disable to close the door of the container again.

Aiming to overcome the inconveniences previously mentioned, several types of flexible liners were developed to be used inside containers, which reflect the current state of the art, and that will be commented below.

The patent document BR 9.202.694, published in Mar. 23, 1993, by Carlos J. D. Matias, illustrates a flexible liner, that is placed inside a container, being that in part of the back wall of the flexible liner are disposed horizontal and vertical bars, and in the intercessions of which will be fixed oblique strips, whose inferior frontal ends will be fixed on the base of the container, and, when loading the flexible liner, these said oblique strips will be pressured, in order to retain said part of the back wall of the flexible liner, objecting to try to prevent said part of back wall from arching, that tends to occur in function of the pressure that it is submitted by the load against the internal surface of said part of the back wall of the flexible liner.

The patent documents U.S. Pat. No. 3,696,952, published in Oct. 10, 1972, and U.S. Pat. No. 3,868,042, published in Feb. 25, 1975, both in name of Sea-Land Service, Inc., illustrate a flexible sack or bag, that is fastened on the internal walls of the container, being that part of back wall of the flexible liner is reinforced along the loading process, through a plate, in order to avoid it from arching outward, and said part of back wall of the liner is further provided with openings, which are conveniently disposed, such as to allow the loading and the discharge of said flexible liner; said openings will be properly sealed during transport of the container.

The patent document U.S. Pat. No. 3,951,284, published in Apr. 20, 1976, by Du Pont Canada, Ltd., illustrates a flexible liner which employs bars disposed on the inferior part of the back wall of the flexible liner, in order to avoid it from arching outward along its loading, and said part of back wall of the flexible liner is also provided with openings, which are conveniently disposed, to allow the loading and discharge of the flexible liner, and these openings will also be properly sealed during transport of the container.

The patent documents U.S. Pat. No. 3,980,196, published in Sep. 14, 1976, and U.S. Pat. No. 4,054,226, published in Oct. 18, 1977, both in name of United States Lines, Inc., illustrate a back frame, which configures a back plate, that will retain the flexible liner inside the container, in order to avoid part of back wall of the flexible liner from arching outward, and prevent the flexible liner from tear.

The patent document U.S. Pat. No. 4,232,803, published in Nov. 11, 1980, by A.I.R. Foundation, illustrates a pair of retainer elements disposed in angle, to support part of back wall of the flexible liner inside the container, and its construction demands a container comprising a double door obligatorily.

The patent document U.S. Pat. No. 4,601,405, published in Jul. 22, 1986, by The Boeing Company, illustrates a device for closing the part of back wall of the flexible liner, provided that said wall part is formed by three triangular plates, whose free vertices are joined by means of strips that will be attached by means of said closing device.

The patent documents EP 280.493 and EP 280.495, both published in Aug. 31, 1988, U.S. Pat. No. 4,792,239, published in Dec. 20, 1988, U.S. Pat. No. 4,801,042, published in Jan. 31, 1898, all in name of Kawasaki Kisen Kaisha, illustrate adjustable strips, which are employed to retain the flexible liner from the internal walls of the container.

The patent document U.S. Pat. No. 4,875,596, published in Oct. 24, 1989, by Jürgen Lohse, illustrates a tubular flexible flask that is supported inside a container, disposed separated from the walls of said container, being that the ends of said tubular flexible flask are joined by means of staple connections.

The patent document U.S. Pat. No. 5,040,693, published in Aug. 20, 1991, by Victor T. Podd and others, illustrates a flexible liner whose back wall is provided with a plurality of horizontal and vertical bars responsible for retaining said part of back wall, in order to avoid it from arching.

The patent document GB 2.226.300, published in Jun. 27, 1990, by Nipon Yusen Kaisha, illustrates a flexible liner that is placed inside a container, and rigid elements are disposed in part of back wall of said flexible liner, in order to avoid said part of the back wall of the flexible liner from arching.

The patent document GB 2.228.468, published in Aug. 29, 1990, by A.P.S. Co. Ltd., illustrates a flexible liner that is placed inside a container, and horizontal bars are disposed in part of back wall of the flexible liner, in order to avoid said part of back wall of the flexible liner from arching.

The patent document FR 2.461.661, published in Feb. 6, 1981, by Pneumatiques, Caoutchouc Manufacture et Plastiques Kleber-Colombes, illustrates a flexible liner, where part of back wall is retained by means of the employment of strips, disposed forming an "X", which are fastened on the side walls of the container.

The patent document EP 21.814, published in Jan. 7, 1981, in name of In Bord Bainne Co-Operative Limited, illustrates a flexible liner that is placed inside a container, and where part of back wall is retained by means of the employment of rigid panels.

The patent document EP 260.652, published in Mar. 23, 1988, by Kawasaki Kisen Kaisha, Ltd., illustrates a flexible liner that is placed inside a container, and horizontal bars are disposed on part of the back wall of the flexible liner, in order to avoid said part of back wall of the flexible liner from arching.

The patent document EP 480.741, published in Apr. 15, 1992, by BJK Industries, Inc., illustrates a flexible liner that is placed inside a container, and horizontal tubular elements are disposed on part of the back wall of the flexible liner, in order to avoid said part of back wall of the flexible liner from arching.

The patent document EP 716.988, published in Jun. 19, 1996, by Caretex A/S, illustrates a flexible liner that is placed inside a container, and a grid element are disposed on part of the back wall of the flexible liner, in order to avoid said part of back wall of the flexible liner from arching.

The patent document EP 982.239, published in Mar. 1, 2000, by Caretex A/S, illustrates a flexible liner that is placed inside a container, and horizontal bars are disposed on part of the back wall of the flexible liner, in order to avoid said part of back wall of the flexible liner from arching.

The patent document EP 1.101.712, published in May 23, 2001, by Caretex A/S, illustrates a flexible liner that is placed inside a container, and reinforcement elements in form of brackets are disposed on part of the back wall of the flexible liner, being that the superior vertices of said bracket elements comprise strips which are fastened one each other, and which are disposed on the middle of the part of the back wall of said flexible liner, in order to avoid it from arching.

In practice, it is observed that all types of flexible liners already known from the state of the art present constructive and/or functional inconveniences, because, in some cases, these flexible liners are provided with an extremely complex construction, what leads to an excessive waste of raw material, a production process involving a high number of stages, and, in other cases, unusual elements are used for the constructive conception of the flexible liner, such as bars, panels, tubular elements or others, which will become one more complicating element in the moment of the discharge from the flexible liner, and in some cases the fastening of the retainer elements that act against the tendency of arching of part of back wall of the flexible liner must be done by means of the employment of muscular force, this necessity does not present enough reliability for the stability of the fastening of the said elements of retention of part of back wall of the flexible liner, since these fastenings, in function of the pressure submitted by the load inside the flexible liner, and due to the movement of the load inside the flexible liner during the transport of the container, may loosen, causing consequently, the detachment of these elements of retention of part of the back wall of the flexible liner, allowing therefore the arching of said part of back wall of the flexible liner, after open the door of the container, preventing it to close again, still occurring critical cases in that the flexible liner tears, causing loss and/or contamination of the load and the container itself.

Aiming to overcome the current inconveniences of the current techniques, a flexible liner for shipping bulk load inside shipping containers and a method for placing said flexible liner for shipping bulk load into a shipping container was designed, comprising basically a flexible sack or bag, made of impermeable plastic material, preferably of impermeable propylene plastic, which is sized to be placed in standard containers, and that will be able to provide the safe transport of bulk loads. It uses fastening means that will keep suspended the flexible liner starting from the superior part of the container, and said container having an optional wall as roof, a floor wall, left and right side walls, a closed front wall and a back wall that may comprise an or more doors, while the flexible liner to be placed inside said container also comprises part of the optional roof wall, part of floor wall, parts of left and right side walls, part of closed front wall and part of back wall, through which the loading of said flexible liner may be performed, and said flexible liner of this invention is characterized by the fact of using means of retention of said part of the back wall of the flexible liner, using frontal transversal retention strips, which are diagonally disposed forming a "X" on the external surface of said part of back wall of the flexible liner, and said frontal transversal retention strips of part of the back wall of the flexible liner will be pressured, aided by a tensioning device, in order to be kept stable, what will be reached by using double buckles, being further intended another vertical fastening strip, which extends centrally from the inferior border of part of the back wall of the flexible liner, and which extends up to a middle height of said part of the back wall of the flexible liner, and said vertical fastening strip will be responsible for keeping the intercession point positioned among these said frontal transversal strips of retention of part of back wall of the flexible liner, and so said frontal transversal strips of retention, as said vertical fastening strip, disposed in the part of the back wall of the flexible liner are made of high traction resistance materials, in order to guarantee a perfect stabilization of said part of the back wall of said flexible liner, reducing substantially the tendency of arching of said part of the back wall of said flexible liner, which occurs in function of the internal pressure that is submitted by the loading of the flexible liner, and, due to the fact that the fastening of said part of the back wall of the flexible liner be performed using a tensioning device, it will be possible to guarantee a great reliability on the retention of said part of the back wall of the flexible liner, with minimum effort from the operator.

Figure 2:
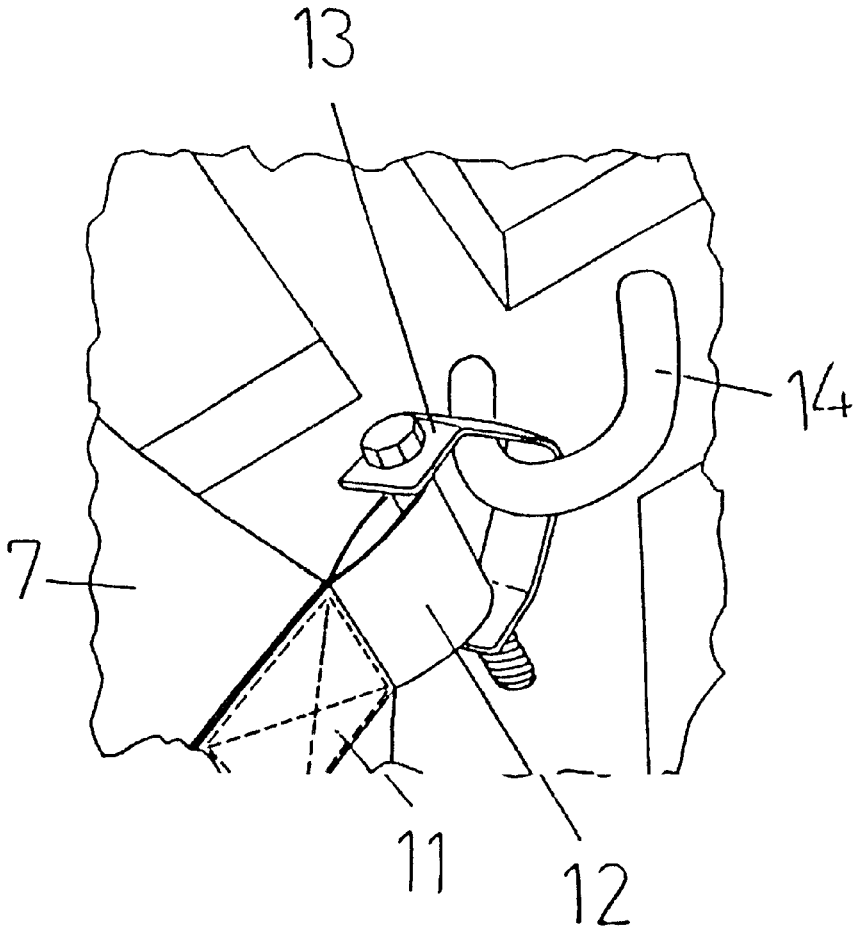
Figure 3:
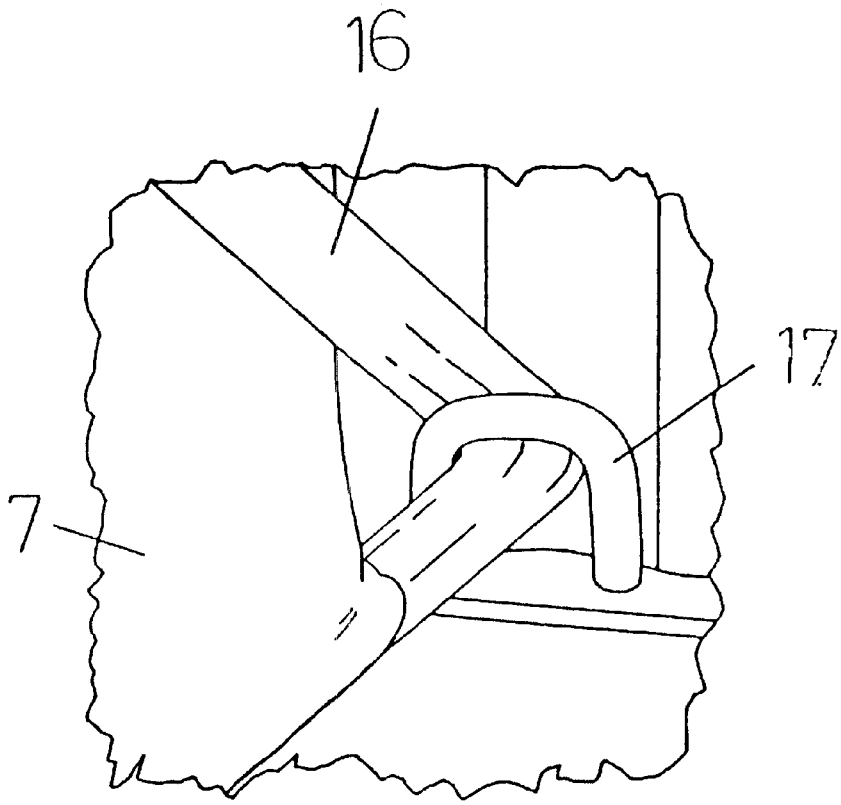
Figure 4:
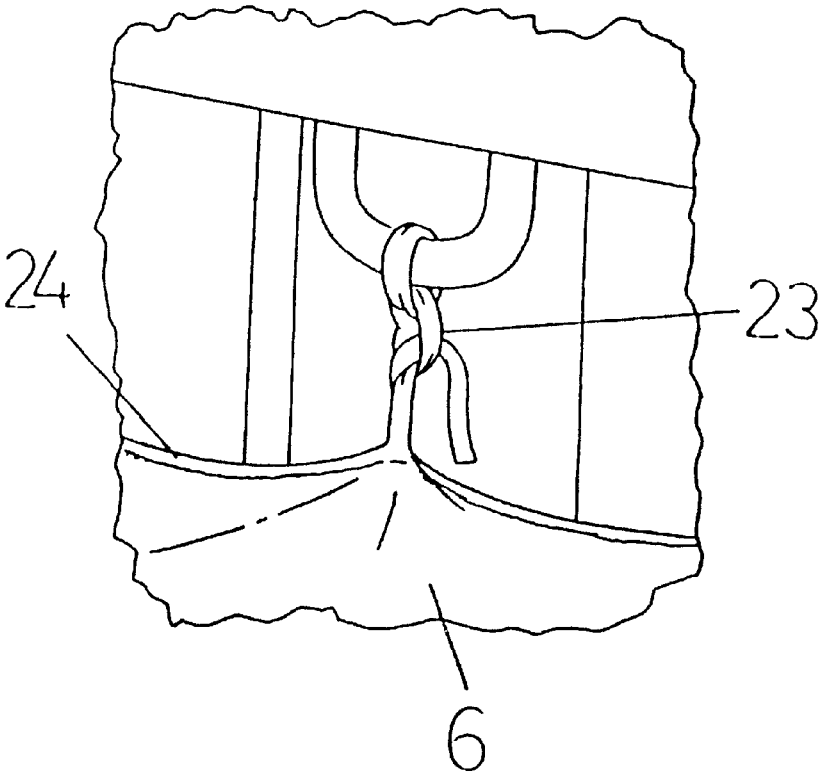
Figure 5:
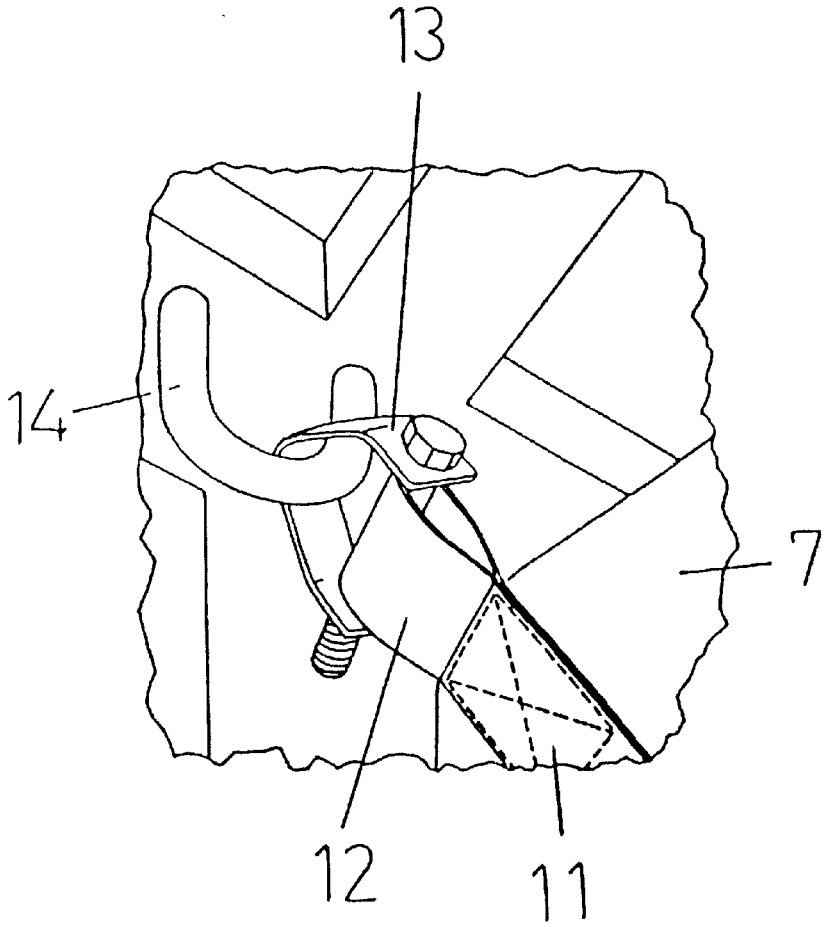
Figure 6:
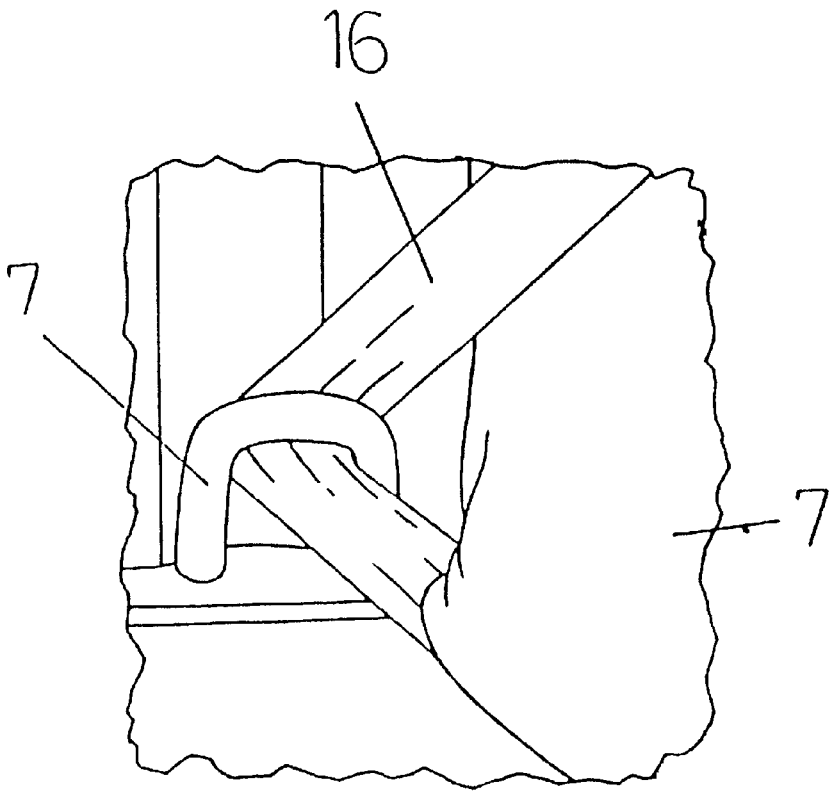
Figure 7:
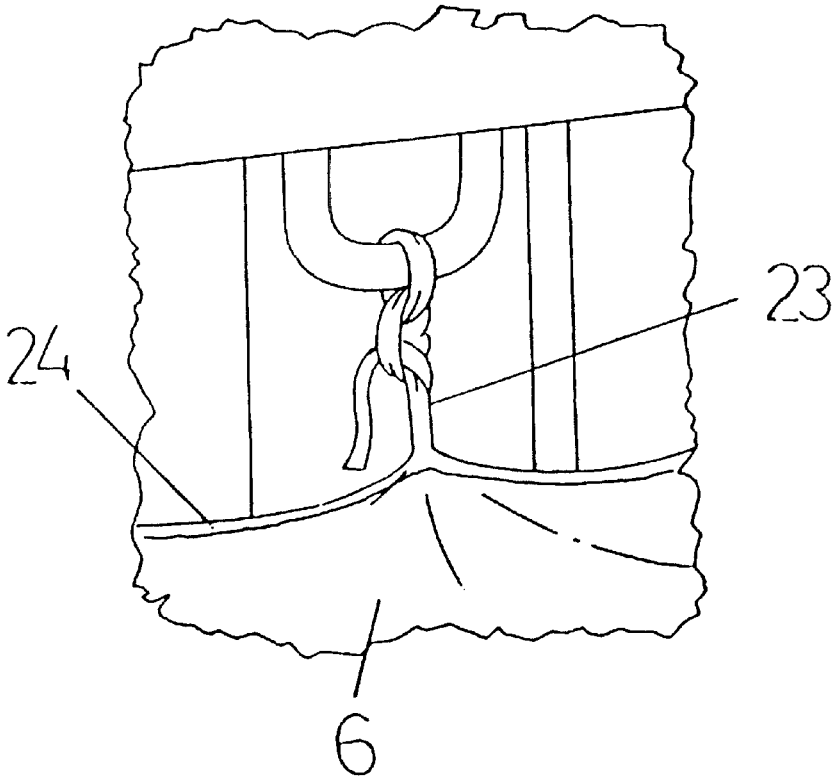
Figure 8:
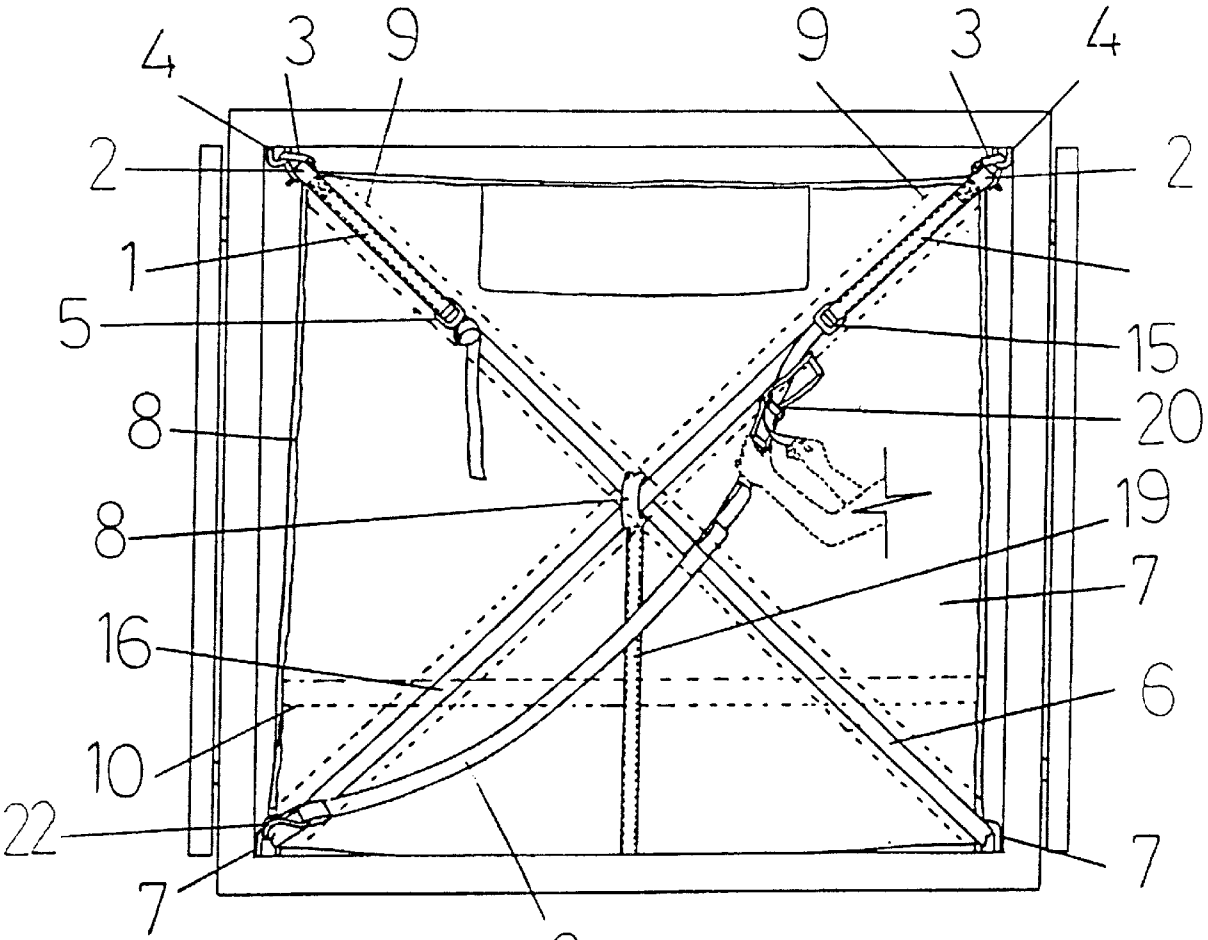
Figure 9:
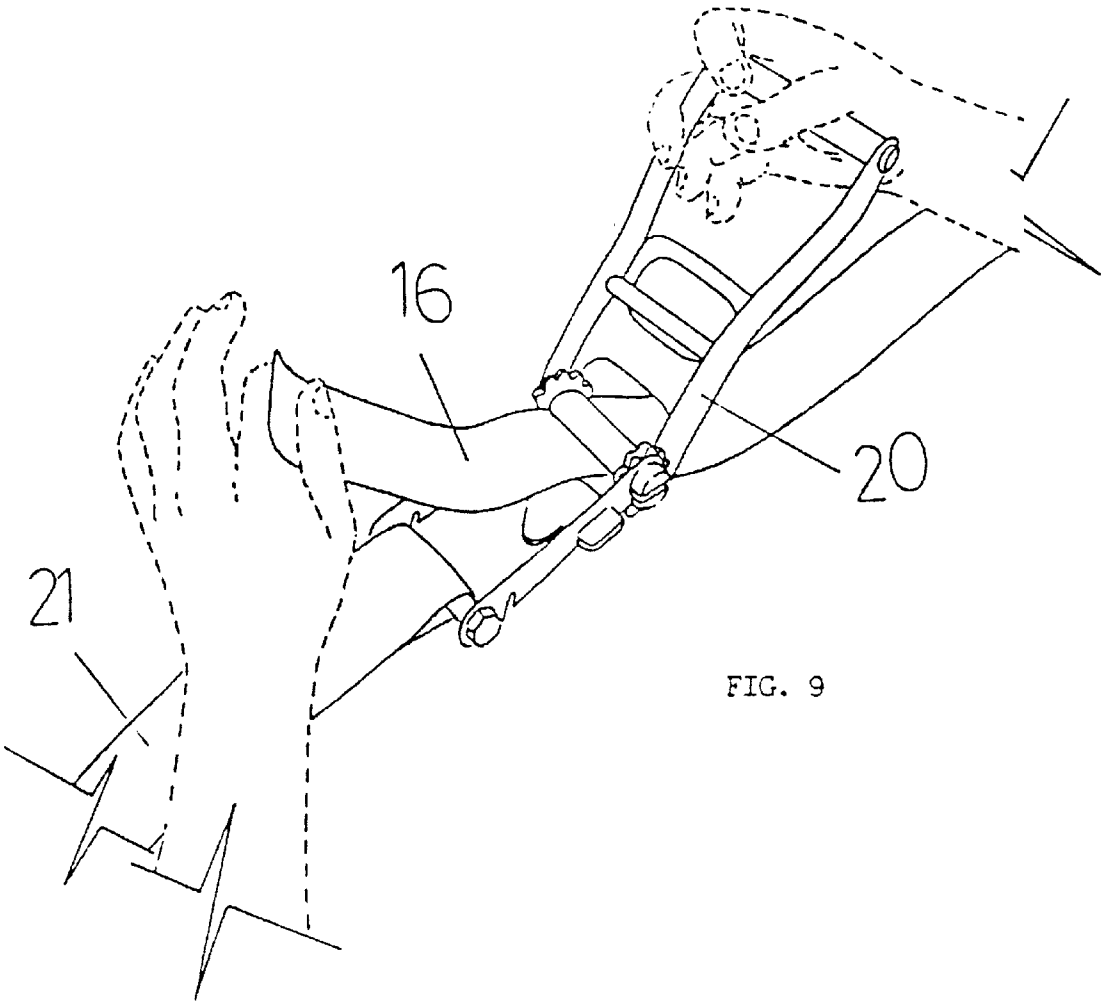
Figure 10:
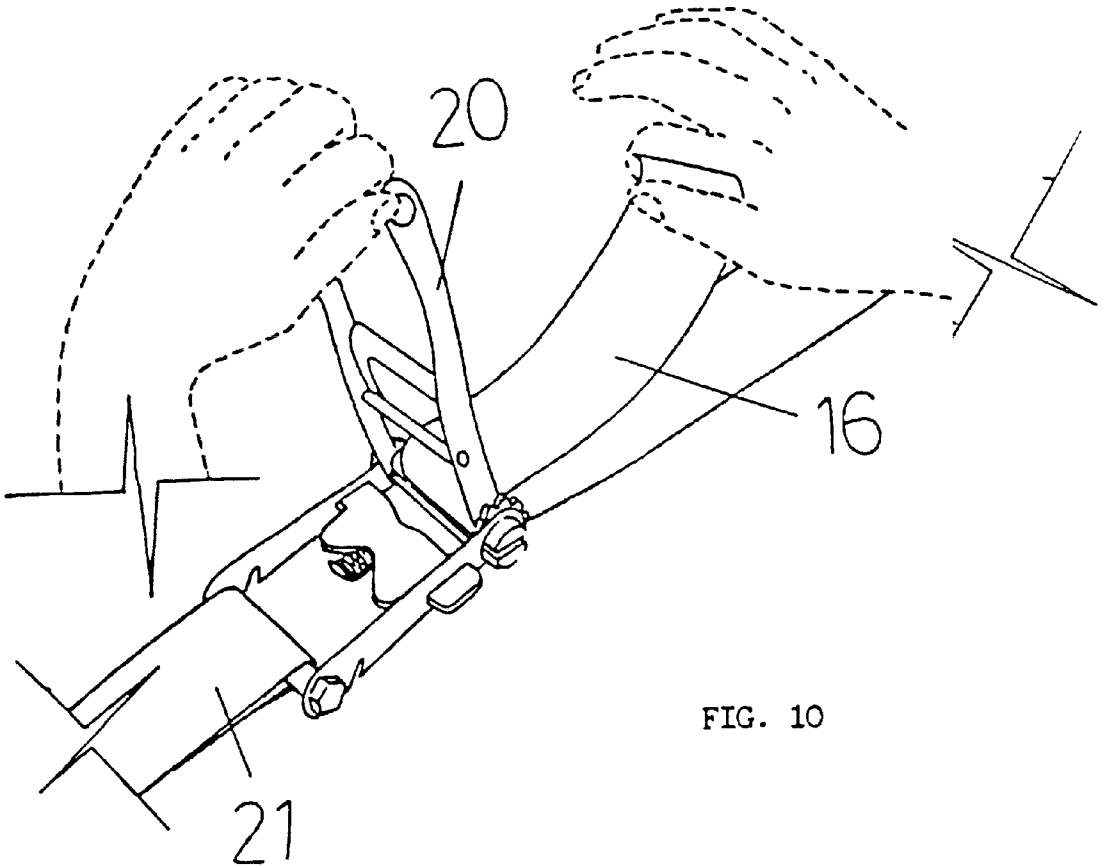
Figure 11:
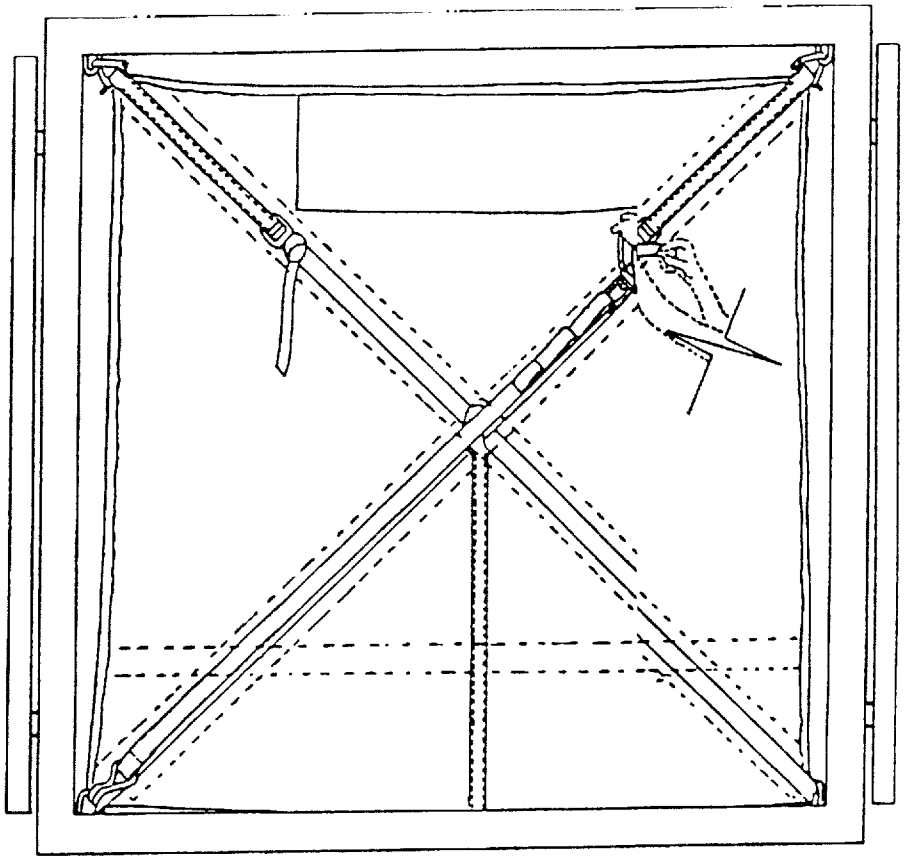
Figure 12:
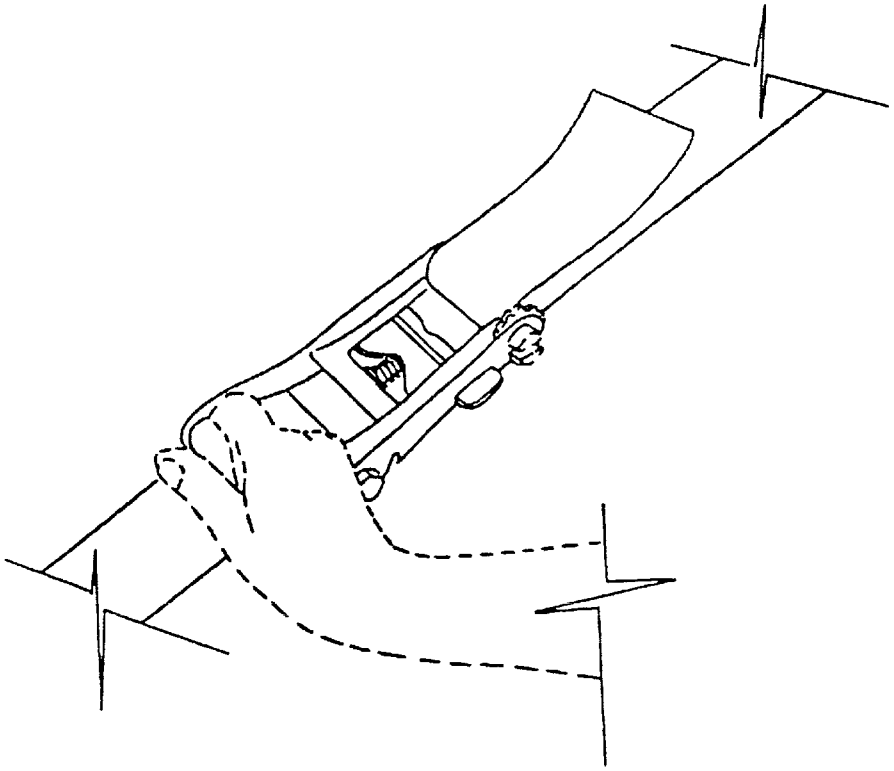
Figure 13:
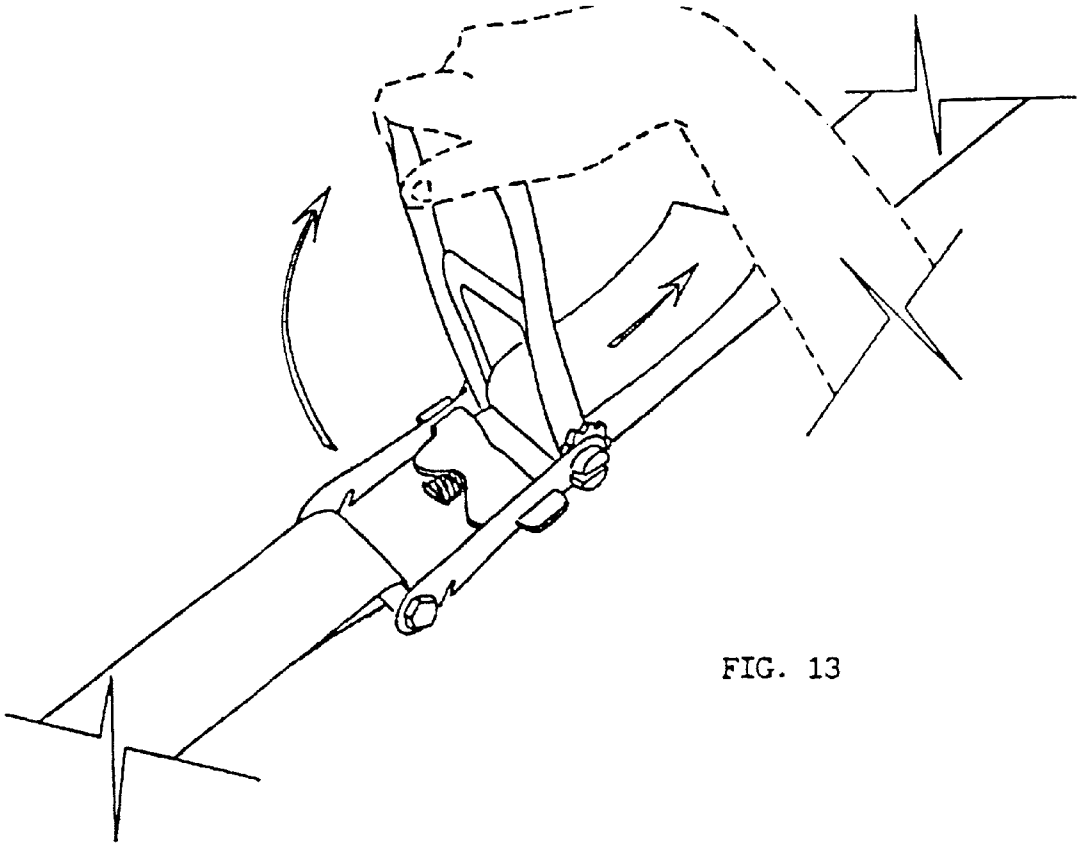
Figure 14:
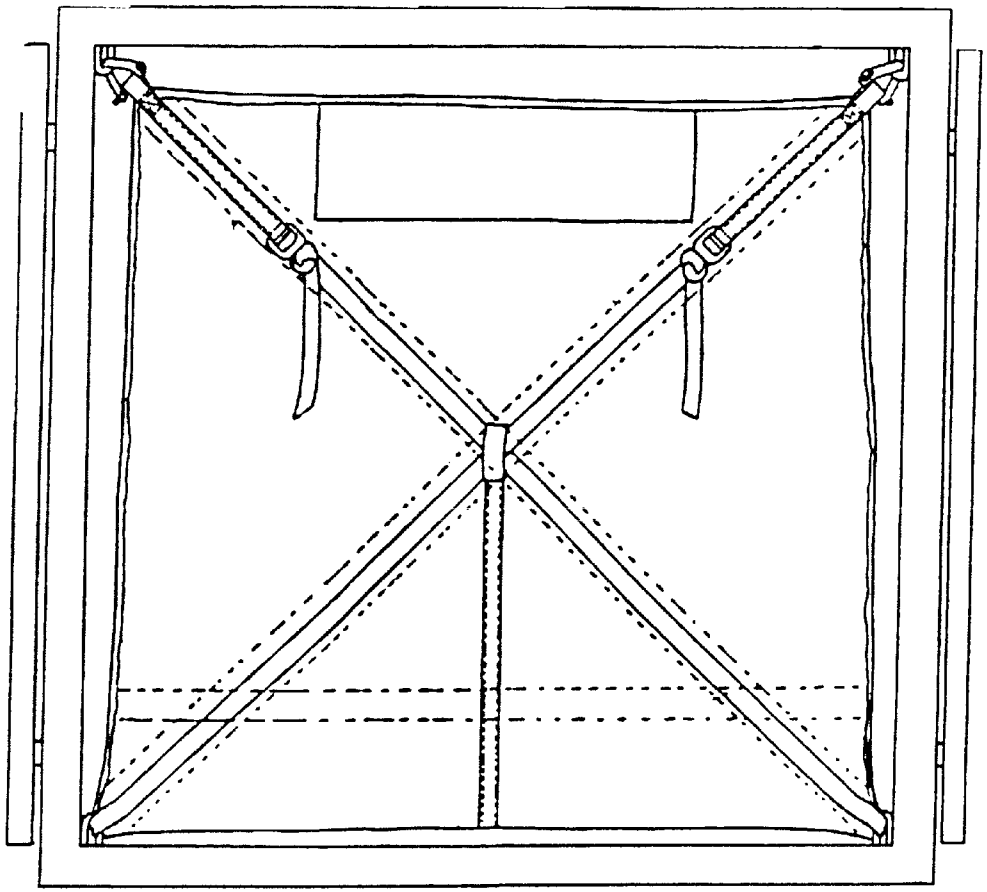
Figure 15:
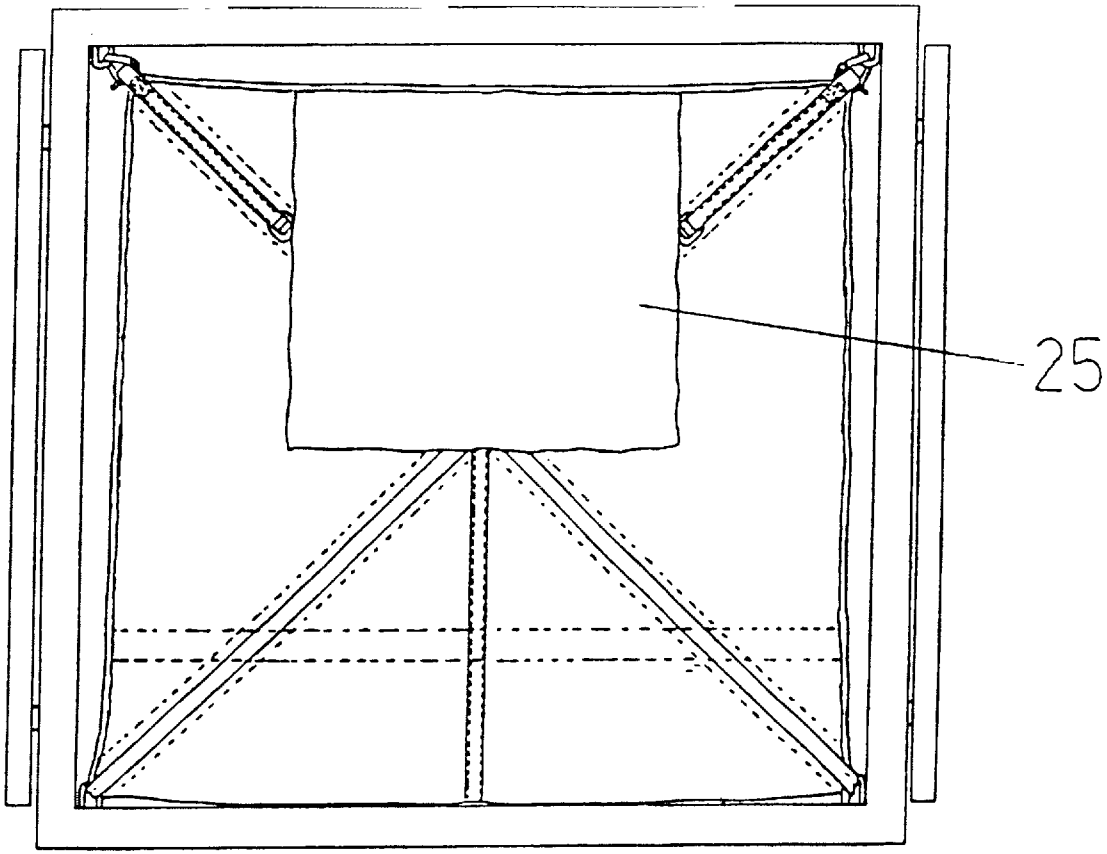
Figure 16:
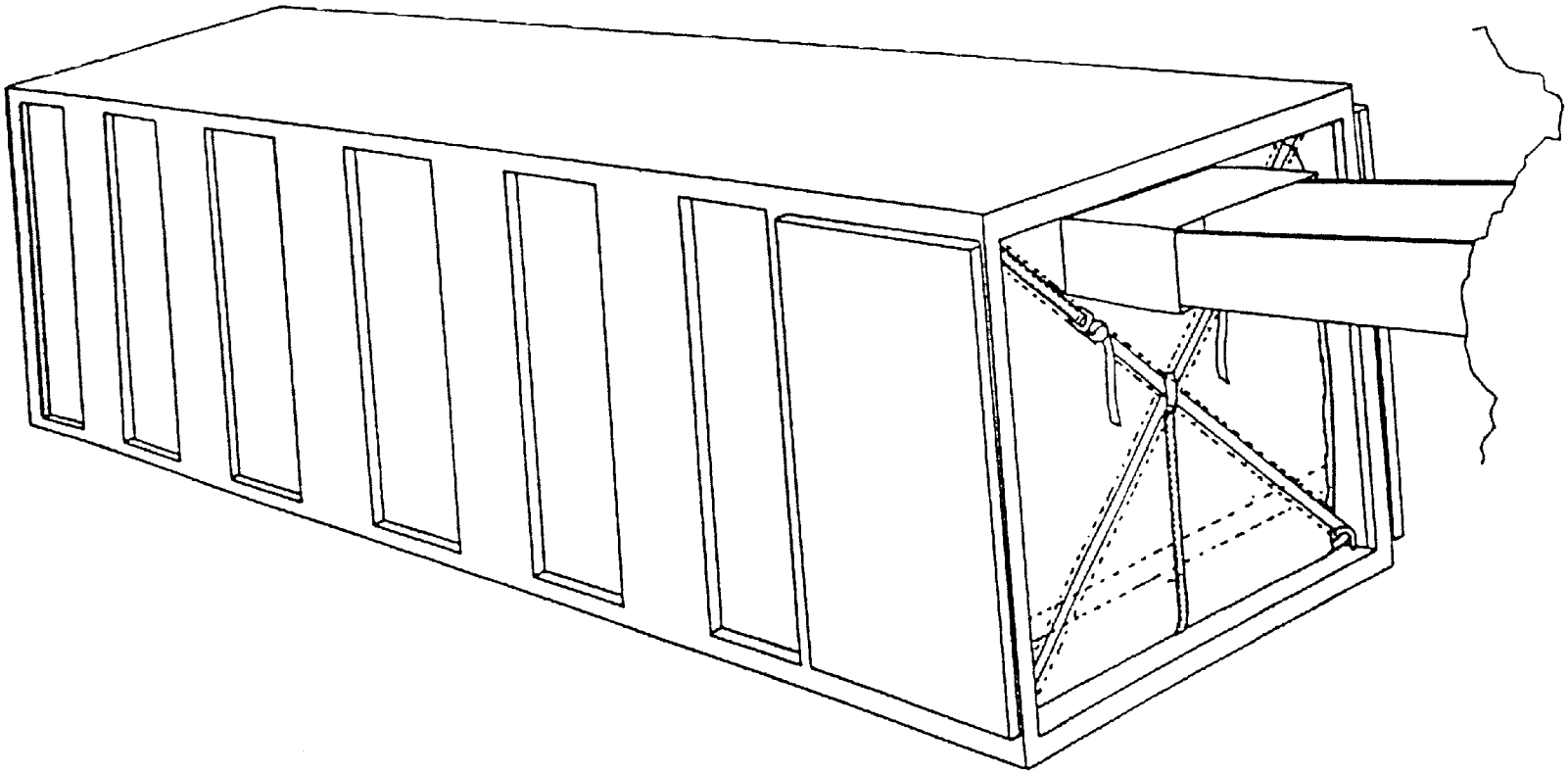
Figure 17:
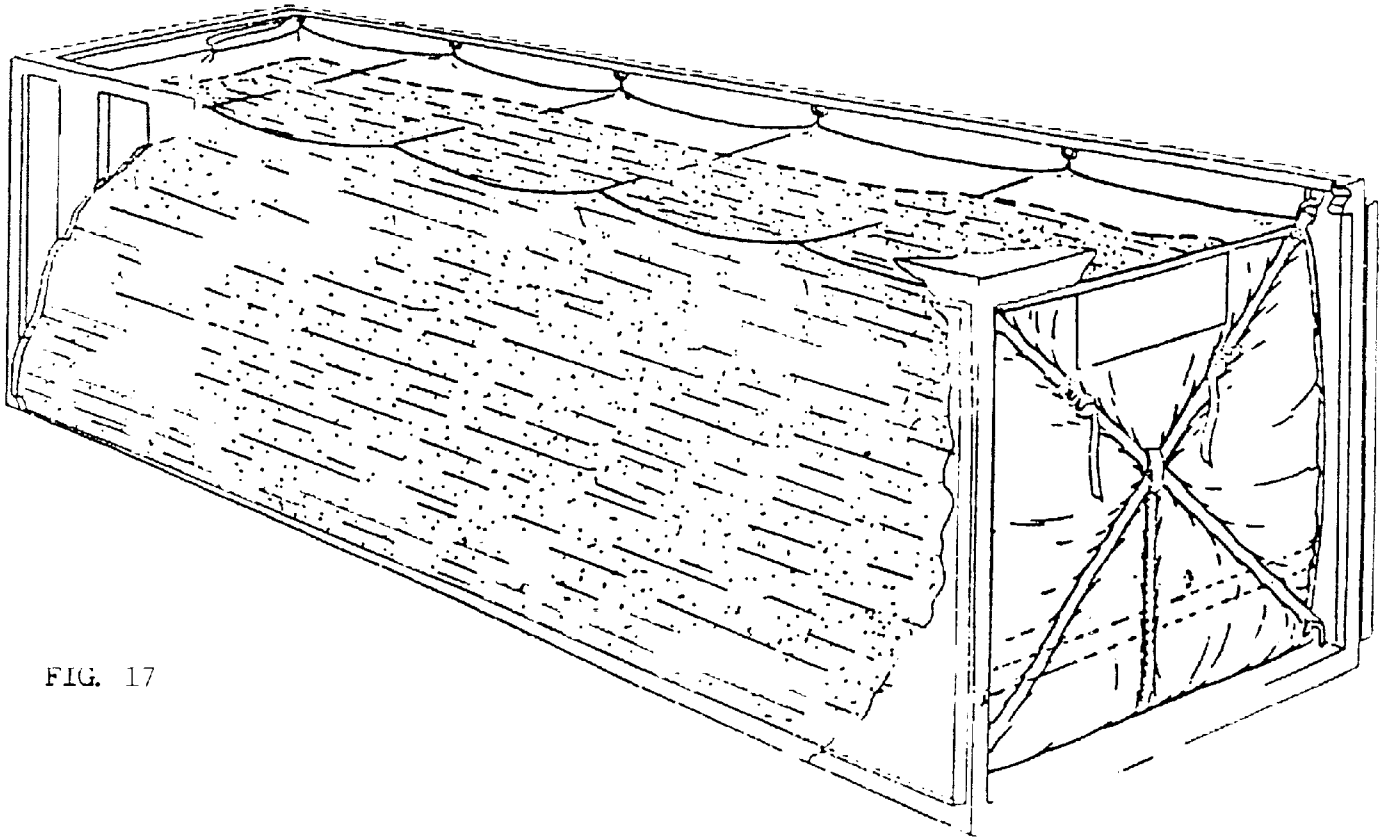

For a better understanding of the flexible liner for shipping bulk load inside shipping containers and method for placing said flexible liner for shipping bulk load into a shipping container, it is made reference to drawings, as follows:

FIG. 1—Perspective view of the flexible liner empty, placed inside the container;

FIG. 2—Detailed view of the fastening of the strip from the superior right side of part of the back wall of the flexible liner with an eyelet of the front superior right side of the container;

FIG. 3—Detailed view of the fastening of the frontal, right side, transversal retention strips of the flexible liner with the frontal inferior right side eyelet of the container;

FIG. 4—Detailed view of the fastening of the superior strip of the right side brim of the flexible liner with the superior right side eyelet of the container;

FIG. 5—Detailed view of the fastening of the frontal superior left side strip of the flexible liner with the frontal superior left side eyelet of the container;

FIG. 6—Detailed view of the fastening of the frontal inferior left side strip of the flexible liner with the frontal inferior left side eyelet of the container;

FIG. 7—Detailed view of the fastening of the superior strip of the left side brim of the flexible liner with the left side eyelet of the container;

FIG. 8—View of the fastening of the free end of one of the frontal transversal strips of retention of part of the back wall of the flexible liner with the tensioning device;

FIG. 9—Detailed view of the fastening of the free end of one of the frontal transversal strips of retention of part of the back wall of the flexible liner in the tensioning device;

FIGS. 10 and 11—Detailed view illustrating the steps for fastening of the free end of one of the frontal transversal strips of retention of part of back wall of the flexible liner in the tensioning device;

FIG. 12—View of the tensioning device for tensioning of one of the frontal transversal strips of retention of part of the back wall of the flexible liner;

FIG. 13—detailed view of the operation of the tensioning device for tensioning of one of the frontal transversal strips of retention of part of the back wall of the flexible liner;

FIG. 14—Frontal view of the flexible liner illustrating the frontal transversal strips of retension of the part of back wall of the flexible liner tensioned;

FIG. 15—Frontal view of the flexible liner empty placed inside the container illustrating its mouthpiece for loading;

FIG. 16—Frontal view of the flexible liner placed inside the container illustrating in mouthpiece for loading coupled with a feeding duct of the silage equipment in the beginning of the loading;

FIG. 17—Front view of the flexible liner placed inside the container after its loading illustrating its mouthpiece of loading closed.

According to all figures, the flexible liner for shipping bulk load inside shipping containers and method for placing said flexible liner for shipping bulk load into a shipping container is constituted basically of a flexible liner (1), that is configured in the form of a sack or bag, and made of impermeable plastic material, and said flexible liner comprising a part of floor wall (2), that rests on the floor of the container, part of left side wall (3) that extends adjacent to the left side wall of the container, part of the right side wall (4) that extends adjacent to the right side wall of the container, part of the closed frontal wall (5) that extends adjacent to the closed frontal wall of the container, part of the roof wall (6) that extends below the roof of the container, and part of the back wall (7) that extends adjacent to the back wall of the container, and in which can be provided one or more doors, and said part of the back wall of the flexible liner is formed by double leaves, which are joined one each other by means of border seams (8), and these seams may also be double seams, in order to minimize the current effects of the concentrated tension that are generated by the holes produced by the seams points, and the internal leaf having further reinforcement seams (9), that are disposed diagonally, forming a "X", on said internal leaf of the part of the back wall of the flexible liner, being further provided another reinforcement seam (10), that is horizontally disposed in the inferior middle area of said internal leaf of the part of the back wall of the flexible liner, and said reinforcement seams are provided to absorb the internal pressure that is submitted by the load against the internal surface of the internal leaf of said part of back wall of the flexible liner, in order the prevent eventual ruptures of said internal leaf of part of the back wall of the flexible liner, while the external leaf of the part of the back wall of the flexible liner is provided with surface treatment, obtained by process of lamination of the external surface of said external leaf of the part of back wall of the flexible liner, in order to provide impermeable characteristics to said external leaf of part of the back wall of the flexible liner, and the impermeable process of said external surface of the external leaf of the part of back wall of the flexible liner aims to guarantee the integrity of the bulk material stored inside the flexible liner, since the back doors of the container are not able to provide total sealing for the interior of the container, water from rain and/or sea, or even humidity may penetrate into the container, these factors may contaminate the load that is stored inside the flexible liner, and, consequently, the container itself, being that strip segments will be sewn (11) on the superior edges of said part of the back wall of the flexible liner, which will also be disposed in the diagonal direction of said part of the back wall of the flexible liner, and these said strip segments present in its free ends that are externally extended to the said part of the back wall of the flexible liner, eyelets (12) in which suspension rings will be placed (13), which will be fixed with the eyelet (14) that are disposed in the frontal superior sides of the container, and in the opposite ends of these said strips segments are disposed double buckles (15) to receive and retain the frontal transversal strips of retention (16) of said part of back wall of the flexible liner, which will be sewn with the inferior side ends of the said part of back wall of the flexible liner, and these said frontal transversal strips of retention of said part of back wall of the flexible liner will be, in a first stage, responsible for the fastening of the inferior part of said part of the back wall of the flexible liner with the eyelets (17), that are disposed in the frontal inferior side of the container, and these said frontal transversal strips of retention of said part of back wall of the flexible liner are extended from said frontal inferior side eyelets of the container passing through the eyelet (18), that is formed on the free end of the vertical fastening strip (19) of said frontal transversal strips of retention of part of the back wall of the flexible liner, which centrally extends from the inferior border of said part of back wall of the flexible liner, and that extends to the middle height of said part of back wall of the flexible liner, and said vertical fastening strip will work in order to guarantee no movement on the position of the intercession point among said frontal transversal strips of retention of said part of back wall of the flexible liner, during the process of loading of the flexible liner as during the transport of the container, and the displacement of the point of intercession of the said frontal transversal strips of retention of part of back wall of the flexible liner tends to occur in function of the internal pressure that is submitted by the load against the internal surface of said part of back wall of the flexible liner, and it may allow an great arching formation, which may be located since above as below said intercession point among said frontal transversal strips of retention of part of back wall of the flexible liner, and said frontal transversal strips of retention of part of back wall of the flexible liner, after passing through said eyelet of said vertical fastening strip, then will be passed through said double buckles disposed on the free ends of the said strip segments, and the tensioning of said frontal transversal strips of retention of said part of the back wall of the flexible liner are performed using the tensioning device (20), which incorporates an secondary strip (21), that is provided with hooks (22), and said hooks will be removable fastened with said frontal inferior side eyelet of the container, and free end of said frontal transversal strip of retention of said part of back wall of the flexible liner is then inserted in a ratchet system existent in said tensioning device, and the stretching of said frontal transversal strips of retention of the part of back wall of the flexible liner is obtained driving the hilt of said tensioning device, in order to promote the appropriate tension on said frontal transversal strips of retention of the part of back wall of the flexible liner, in order to provide total reliability in reference to the maintenance of the retention of said part of back wall of the flexible liner to great arching formation, in function of the pressure submitted by the load inside the flexible liner, and, both said frontal transversal strips of retention and said vertical fastening strip of said part of back wall of the flexible liner will be made of materials which are provided with high traction resistance, and said parts of the left and right side walls of the flexible liner will be kept suspended by means of superior side strips (23), which are sewn in the superior side brims (24) of the flexible liner, and these said superior side strips will be tied to the superior side eyelet of the container, and the loading of the flexible liner will be performed by means of a mouthpiece (25), which is obliquely disposed in the superior central region of said part of the back wall of the flexible liner, and to which the feeding duct of the silage equipment will be coupled, being that after finishing the process of loading of the flexible liner the said mouthpiece will be closed by fastening the strips that are disposed around said mouthpiece.

It has to be observed that the innovations introduced by the flexible liner for shipping bulk load inside shipping containers and method for placing said flexible liner for shipping bulk load into a shipping container have the main purpose to provide a great reducing for the arching formation in said part of back wall of the flexible liner; therefore the employment of said parts of floor walls, parts of left and right side walls, and part of roof wall are optional, and their use will be determined, basically, in function of the type of the load to be transported, as well as the means of load feeding, which is preferably performed by means of an opening provided in the superior part of the part of the back wall of the flexible liner, which may be positioned at any other part of it, being able or not to be used together with the air and/or dust exhausting means, and the load feeding inside the flexible liner will still be able to be performed by means of openings that may be disposed in the roof of the container, matching with the openings disposed in part of the optional wall of the roof of the flexible liner.

The method for placing the flexible liner for shipping bulk load into a shipping container is performed as follows:

The flexible liner is placed folded inside the container in order to allow initially part of back wall of the flexible liner may be lifted up, so that in one of the eyelet placed on the superior end of the strip segment that is externally extended to said part of back wall of the flexible liner may be provided with a suspension ring, which will be subsequently fastened with the frontal superior side eyelet of the container, and after that the superior side strips disposed in the superior side brims of the flexible liner are fastened with the superior side eyelet provided in the superior part of the internal walls of the container, so that the parts of left and right side walls of the flexible liner in order to suspend the parts of the left and right side walls of the flexible liner, and subsequently another suspension ring is applied with the other eyelet provided in the superior end of the other strip segment that extends externally to said part of back wall of the flexible liner, and said suspension ring is then fastened in the other frontal superior side eyelet of the container, after that one of the frontal transversal strips of retention of part of back wall of the flexible liner is passed through both frontal inferior side eyelet of the container and the eyelet provided in the free end of the vertical fastening strip, and then passed through the double buckles, being that the free end of said frontal transversal strip of retention of part of back wall of the flexible liner is then inserted into the ratchet system of the tensioning device, which will have its secondary strip fastened by means of the hooks provided in its free end, in the corresponding frontal inferior side eyelet, and, once the frontal transversal strips of retention of part of back wall of the flexible liner are fixed in the ratchet system of the tensioning device, it will actuate by means of its hilt element to obtain an appropriate tension of said frontal transversal strip of retention of part of back wall of the flexible liner, and this tension is kept by means of said double buckles, which prevent the frontal transversal strip of retention of the part of the back wall of the flexible liner from return, after that the fastening hook of said frontal inferior side eyelet of the container is retired, as well as the free end of the frontal transversal strip of retention of part of back wall of the flexible liner of the ratchet system of the tensioning device, being that this free end of said frontal transversal strip of retention of the part of the back wall of the flexible liner is provided with a knot to prevent any possible distention of the frontal transversal strip of retention of part of back wall of the flexible liner, and this procedure should be repeated with the other frontal transversal strip of retention of part of back wall of the flexible liner, after that the feeding mouthpiece is removed from the surface of part of back wall of the flexible liner, being then coupled to the duct of the silage equipment, in order to proceed the loading of the flexible liner, and after that, the mouthpiece is retracted back again to the interior of the flexible liner, having its opening sealed with the fastening of the strips that are disposed around said mouthpiece.

What is claimed is:

1. A device for transporting bulk material inside a shipping container having first, second, third and fourth eyelets at each corner, comprising:

a flexible liner having a bulk receiving area bounded by a floor wall, first and second side walls, a front wall, a back wall, and a roof wall, a plurality of straps extending along opposing edges of said roof wall for removably securing said flexible liner inside said container in a suspended configuration, a first strap disposed on said back wall and extending from a first corner of said back wall, said first strap having an eyelet at one end and a buckle at an opposing end, a second strap disposed on said back wall and extending from a second corner of said back wall, said second strap having an eyelet at one end and a buckle at an opposing, a third strap extending from a third corner of said back wall and having a free end, a fourth strap extending from a fourth corner of said back wall an having a free end, a vertical fastening strap having a loop at one end and being secured to said back wall of said flexible liner at an opposing end, wherein said third strap free end extending through said container third eyelet, said loop, and said second strap buckle connecting said third strap with said second strap, said fourth strap free end extending through said container fourth eyelet, said loop, and said first strap buckle connecting said fourth strap to said first strap, said first strap eyelet being secured to said container first eyelet and said second strap eyelet being secured to said container second eyelet.

2. A device for transporting bulk material according to claim 1, further comprising a removable strap portion having a free end and a tensioning ratchet device at an opposing end, wherein said removable strap portion is secured to said container third eyelet a said free end, and said tensioning ratchet device is operable connected to said free end of said third strap thereby pulling and tensioning said third and second straps.

3. A device for transporting bulk material according to claim 1, further comprising a removable strap portion having a free end and a tensioning ratchet device at an opposing end, wherein said removable strap portion is secured to said container fourth eyelet at said free end, and said tensioning ratchet device is operably connected to said free end of said first strap thereby pulling and tensioning said first and fourth straps.

4. A device for transporting bulk material according to claim 1, further comprising first and second suspension rings, wherein said first and second suspension rings removably secure first strap eyelet and second strap eyelet to said container first and said second container eyelets respectively.

5. A device for transporting bulk material according to claim 1, wherein said flexible liner is made of plastic.

6. A device for transporting bulk material according to claim 1, wherein said back wall is made of an inner leaf and an outer leaf seamed to said inner leaf.

7. A device for transporting bulk material according to claim 6, wherein said outer leaf includes a surface treatment.

8. A device for transporting bulk material according to claim 1, wherein said back wall includes an inlet opening for loading bulk material inside said flexible liner.

* * * * *